United States Patent [19]

Vailati et al.

[11] Patent Number: 4,551,994

[45] Date of Patent: Nov. 12, 1985

[54] WAISTBAND FABRIC

[75] Inventors: Tony Vailati, Graham; Joseph A. Murray, Burlington, both of N.C.

[73] Assignee: Olympic Narrow Fabrics Company, Inc., Graham, N.C.

[21] Appl. No.: 602,924

[22] Filed: Apr. 23, 1984

[51] Int. Cl.[4] ..... D04B 23/08

[52] U.S. Cl. ..... 66/193; 66/190; 66/202

[58] Field of Search ..... 66/190, 192, 193, 195, 66/202

[56] References Cited

U.S. PATENT DOCUMENTS

| | | | |
|---|---|---|---|
| 3,258,941 | 7/1966 | Formenti | 66/193 |
| 3,673,820 | 3/1970 | Sarmiento | 66/193 |
| 4,009,597 | 3/1977 | Wall et al. | 66/193 |
| 4,244,199 | 1/1981 | Rhode | 66/202 |
| 4,248,064 | 2/1981 | Odham | 66/190 |

*Primary Examiner*—Ronald Feldbaum

*Attorney, Agent, or Firm*—B. B. Olive

[57] ABSTRACT

An integral waistband construction is characterized by having side by side lengthwise extending portions of different construction one of which provides roll resistance and the other of which provides decorative and comfortable wearing character to the fabric.

3 Claims, 13 Drawing Figures

WAISTBAND FABRIC

TECHNICAL FIELD

The invention relates to waistbands of the type sewn into pants in the waist region and more specifically to waistbands having a roll resistant characteristic in at least a portion thereof.

BACKGROUND ART

It has been a common practice in the garment manufacturing industry to incorporate a waistband in the waist region of pants. Waistbands are used in both men's and women's pants, shorts, and other garments. However, the application of waistbands to men's pants will be used by way of example from which application of the invention waistband to other type garments will be readily apparent to those skilled in the art. The waistband is typically made up as a narrow width fabric by a narrow fabric producer and is sold to the binding or garment manufacturer as a component. A popular type of waistband is made up as schematically illustrated in FIG. 1 of two knitted fabric strips which are sewn together lengthwise after each of the strips have been separately knitted typically on a crochet type knitting machine. One of the strips comprises a plain elastic stitch fabric with substantial longitudinal stretch and minimal or substantially no widthwise stretch. This first mentioned strip is sometimes made decorative and also made for wearing comfort since it is often exposed in the finished garment, dependent on the type of waistband fabrication. The other portion of the waistband which is typically hidden in the garment is made with an anti-roll construction which in use resists rolling of the waistband on itself particularly when the finished pants are worn by men with protruding abdominal body configurations. The portion of the waistband exhibiting the anti-roll characteristic is also conventionally made on a crochet machine as a narrow width fabric. The strip of fabric exhibiting the anti-roll characteristic also typically exhibits longitudinal stretch but minimal or substantially no widthwise stretch. The two strips are separately finished with finishing techniques suited to their particular characteristics and the finishing steps are followed by a sewing step which joins two edges of the two separate strips together as a continuous length to produce the final composite waistband strip. A roll of such narrow width waistband fabric is then sold by the narrow fabric producer to the binding or garment manufacturer for use in the finished garment according to various waistband fabrication practices, some of which are later described.

In another practice, a narrow width fabric is crochet knit with an anti-roll characteristic extending completely across the fabric widthwise as schematically illustrated in FIG. 2. This anti-roll narrow fabric is then finished and sold to the binding or garment manufacturer. Such waistband fabric also typically exhibits substantial longitudinal stretch and minimal or substantially no widthwise stretch. This practice as diagrammed in FIG. 2 has the advantage of having to finish only a single fabric strip and eliminates the sewing step illustrated in FIG. 1. However, the resulting waistband fabric, while roll resistant, is generally not comfortable to wear, does not provide a portion that can be both comfortable and decorative and does not readily lend itself to being incorporated in a stretch garment fabric in which the waistband is completely or partially hidden in the manner of FIGS. 12 and 13 as later referred to.

A machine crochet knit narrow width elastic fabric can be made with uncovered elastic yarns since the crochet knitting process lends itself to using the filling yarns as cover for the otherwise uncovered elastic yarns. A woven narrow waistband fabric having both a lengthwise extending anti-roll construction as well as lengthwise extending plain weave decorative construction is disclosed in U.S. Pat. No. 3,813,698. The use of monofilament yarns in the widthwise direction to add stiffness is disclosed but in a woven as distinct from a knitted construction. Moreover, such woven waistband fabric is noted as requiring the use of covered elastic yarns as contrasted to use of the substantially less expensive uncovered elastic yarns as in the present invention waistband.

U.S. Pat. No. 3,311,927 teaches a waistband having upper and lower longitudinally extending elastic, waistband sections merging at mating edges with the upper section being elastic only in the longitudinal direction and the lower section being elastic in both longitudinal and transverse or widthwise direction. The lower section is described as being adapted to resist rollover. However, no specific information concerning type of machine employed, construction, yarns, elasticity, or the like, is given. The patent nevertheless states that the described fabric can be made either as sewn together strips or integrally by weaving, knitting, braiding or on what is referred to as a "Galon" type of machine.

U.S. Pat. Nos. 3,858,622 and 3,920,054 describe other types of narrow, woven waistband fabric and give useful background information concerning the desired anti-roll characteristic in a waistband fabric. U.S. Pat. No. 3,170,599 is also noted for background in teaching the importance of having a waistband fabric which tends to lay flat for handling and cutting during fabrication of the garment.

Other aspects of the prior art of significance to the invention relates to how the waistband is attached to the garment material, how the waistband retracts and expands with relation to the garment fabric, how the waistband resists rollover in service when attached to the garment fabric, how the waistband and attached garment fabric individually behave with respect to shrinkage during cleaning and how the garment and waistband fabric elastic, roll resistant and wear characteristics generally change during the life of the garment. The objective of achieving the ideal waistband fabric for all applications has thus long faced the industry.

With the foregoing background in mind it thus becomes the object of the present invention to provide a machine crochet knit waistband fabric of integral construction with one upper lengthwise extending portion exhibiting a substantially anti-roll characteristic and another lower lengthwise extending portion exhibiting both a decorative and comfortable wearing construction. The invention also has as a further object the elimination of the described conventional strip sewing operation. A further object is that of providing a waistband fabric which can be finished as an integral strip in one finishing operation. Additionally, the invention has as an object the provision of an integrally knit waistband fabric which does not tend to curl on itself longitudinally or transversely, which tends to lay flat for handling and cutting, provides a balanced construction longitudinally and transversely, exhibits substantial and substantially equal longitudinal stretch in both upper and lower portions and minimal or substantially no transverse stretch, is specifically adapted to use with garments made of stretch fabric and otherwise exhibits commercially satisfactory cleaning and wear characteristics. These and other objects of the invention will become apparent as the description proceeds.

DISCLOSURE OF INVENTION

In the illustrated embodiment of the invention, a narrow width fabric is knit on a crochet machine to produce a continuous length of integrally formed narrow width fabric suitable to application as a waistband. The construction employed leads to providing an anti-roll characteristic in one lengthwise extending, typically covered portion of the fabric and a decorative appearance and comfortable wearing characteristic in the other lengthwise extending portion of the fabric and which may be exposed in the garment or covered and made of a non-decorative appearance. This integrally formed waistband fabric is then finished in a single finish operation following which it is incorporated in the garment. The particular integral crochet knit fabric construction employed in making the waistband fabric of the invention has been found to produce a fabric which has essentially no tendency to curl on itself longitudinally or transversely, tends to lay flat for handling and cutting, provides a balanced construction, both longitudinally and transversely as described above and is particularly practical for incorporation in garments made of stretch fabric material and partially or fully covered by the garment fabric.

In contrast to the prior art, the present invention thus provides a waistband fabric made up of a single integral construction rather than two separate constructions separately formed and sewn together. The integral waistband fabric of the invention can also be finished in a single finish operation and sent directly from such single finish operation to the binding or garment manufacturer for incorporation in the garment.

Another distinct advantage of the invention waistband fabric resides in the fact that uncovered elastic yarn can be employed and the crochet knitting process itself utilized to provide adequate covering for the elastic yarns employed in the waistband fabric. Other distinctions and advantages of the fabric with relation to the prior art will become apparent as the description proceeds.

BEST MODE FOR CARRYING OUT THE INVETION

Figure 1:
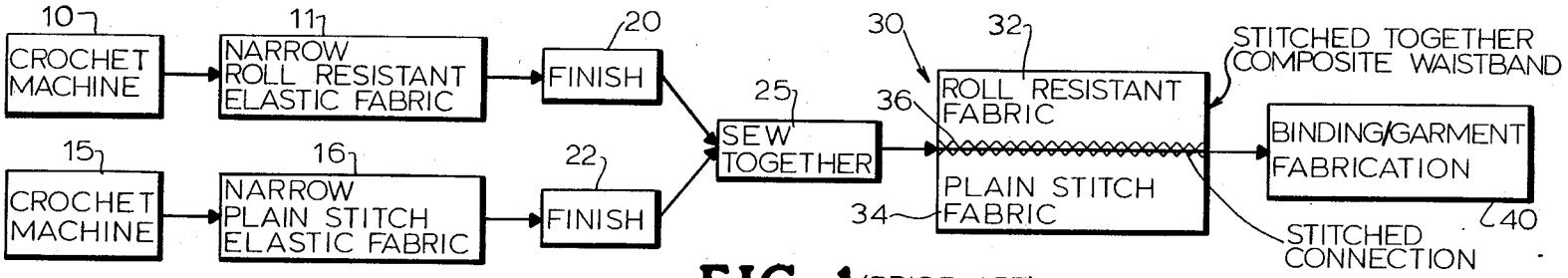
FIG. 1 (PRIOR ART)
FIG. 1 is a somewhat schematic diagram illustrating a prior art method of making waistband fabric.
Figure 6:
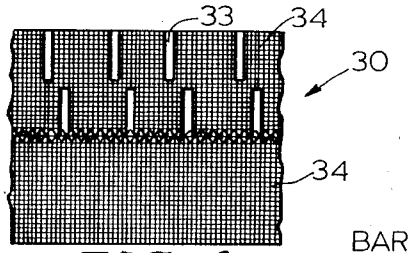
FIG. 6 (PRIOR ART)
FIG. 6 is a plan front side view of a section of the fabric produced by the method of FIG. 1.

With reference to FIG. 1, there is schematically illustrated the previously-mentioned prior art method for making waistband fabric. In FIG. 1, it will be noted that one crochet machine designated 10 is utilized to produce a narrow roll resistant elastic fabric 11 whereas another crochet machine designated 15 is used to separately produce a decorative and comfortably wearing narrow plain stitch elastic fabric 16. The narrow strip of roll resistant elastic fabric 11 is then passed through a finish operation designated 20 with the steps of such operation being suited to the particular characteristic of the roll resistant elastic fabric 11. The other fabric 16 is put through a separate finish operation designated 22 with the characteristics of finish operation 22 being suited to the particular characteristics of the fabric 16. After finishing, the two fabric strips are then passed through a sewing operation 25 to produce a stitched together composite waistband 30 having one lengthwise extending portion 32 with a widthwise roll resistant fabric construction having stiffening rib-like formations 33 on the front side as viewed in FIG. 6 and another lengthwise extending portion 34 formed as a decorative and comfortably wearing plain stitch fabric and with a stitched connection 36. The composite waistband 30 of the prior art, also illustrated in FIG. 6, is then transferred to the binding or garment fabrication step designated 40 in FIG. 1.

Figure 2:
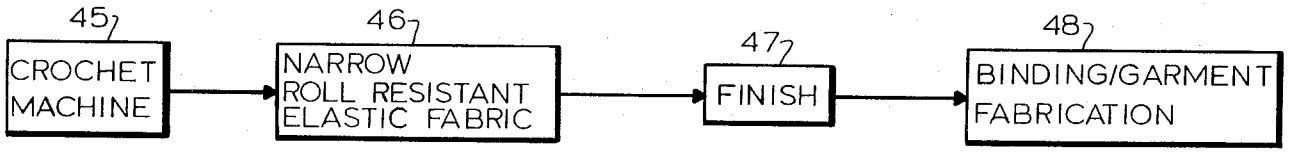
FIG. 2 (PRIOR ART)
FIG. 2 is a somewhat schematic diagram illustrating another prior art method of making waistband fabric.
Figure 7:
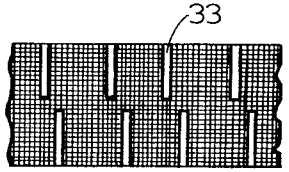
FIG. 7 (PRIOR ART)
FIG. 7 is a plan front side view of a section of the fabric produced by the method of FIG. 2.

With reference to FIG. 2, another practice has been to use a single crochet machine 45 to produce a narrow elastic fabric 46, illustrated in FIG. 7, exhibiting a roll resistant characteristic over the entire width of the fabric. The mentioned roll resistant fabric 46 is then passed through a single finish 47 and then to the binding or garment fabrication operation 48.

Figure 5:
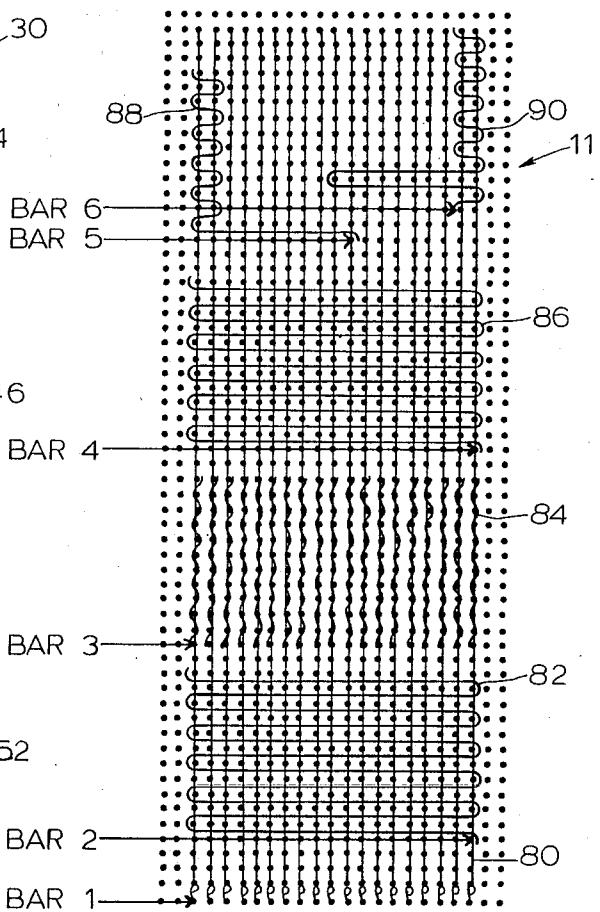
FIG. 5 (PRIOR ART)
FIG. 5 is a knitting diagram for a crochet machine made prior art fabric typically employed as a roll resistant fabric.
Figure 9:
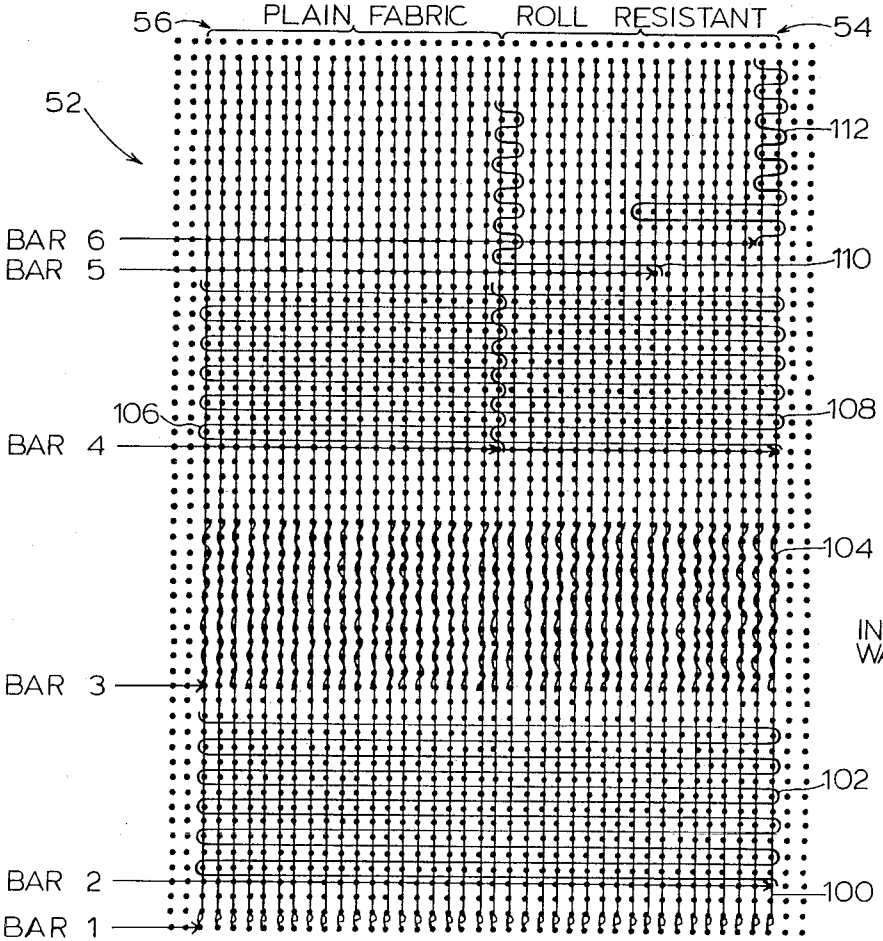
FIG. 9 is a knitting diagram for the crochet machine made composite integrally knitted waistband of the present invention.

The crochet machine warp knitting technique is well established. For reference, a crochet machine deemed suitable for the purpose of the invention is the Comez Model PB-800 crochet machine made by S.p.A.V. Rimoldi & C. of Milano, Italy. The knitting diagrams illustrated in FIGS. 4, 5 and 9 represent knitting diagrams of the type associated with the Comez type crochet machine and are therefore well understood in the art.

Figure 3:
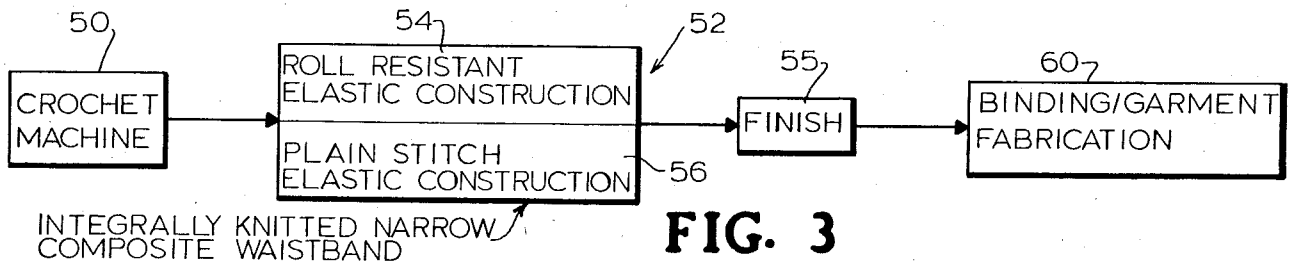
FIG. 3 is a schematic diagram illustrating the manufacture of waistband fabric according to the present invention.
Figure 8:
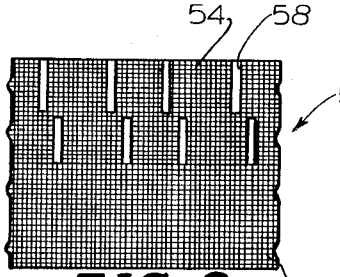
FIG. 8 is a plan front side view of a section of fabric produced by the invention method of FIG. 3.

Making reference next to FIG. 3, a single crochet machine 50, according to the invention, is set to produce a single narrow width fabric strip 52, illustrated in FIG. 8, with one lengthwise extending portion 54 having a roll resistant elastic construction and another lengthwise extending portion 56 having a plain stitch elastic construction. This single integrally knitted composite waistband strip is then passed through a single finish operation 55 and then to the binding or garment fabrication step 60.

A brief comparison of the diagrams of FIGS. 1 and 2 with that of FIG. 3 will immediately reveal to those skilled in the art the significant advantages afforded by a composite waistband construction which can be made on a single crochet machine and at the same time achieve both the desired roll resistant elastic strip construction as well as the plain stitch elastic strip construction needed in the finished waistband product. Additionally, the single finish operation eliminates one of the finishing steps of the prior art construction as well as the sewing step required by the prior art construction of FIG. 1. Other advantages hereafter described are also achieved.

Figure 4:
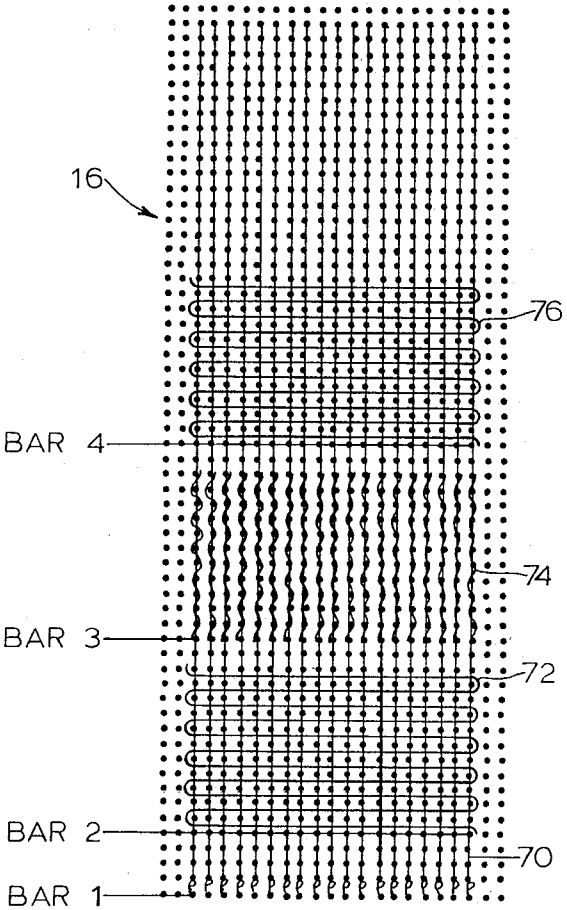
FIG. 4 (PRIOR ART)
FIG. 4 is a knitting diagram for a crochet machine made prior art elastic fabric typically employed as a decorative and comfortable wearing portion of a waistband.

With more specific reference to the prior art constructions related to the invention fabric construction, there is illustrated in FIG. 4 a plain stitch elastic fabric diagram for knitting the conventional narrow plain stitch elastic fabric 16 shown in FIG. 1 on a crochet knitting machine. In FIG. 5, there is illustrated a stitch diagram for knitting on a crochet knitting machine the roll resistant elastic fabric 12 as illustrated in FIG. 1 or the roll resistant fabric 46 as illustrated in FIG. 2. Thus, in order to achieve the prior art composite waistband 30 seen in FIG. 1 and also illustrated in FIG. 6, it was necessary to knit both the plain stitch elastic fabric 16 according to the representative construction of FIG. 4 and to separately knit the roll resistant elastic fabric according to the construction diagram of FIG. 5. Strips of the fabric 12 and fabric 16 as previously mentioned were sewn together with the stitch 36 after finishing to produce the waistband 30 of the prior art with the respective roll resistant portion 32 and plain fabric portion 34 as in FIG. 1.

In FIG. 9, the knitting diagram for the waistband fabric 52 of the invention is illustrated. The roll resistant elastic construction 54 is shown illustrated alongside the plain stitch elastic construction 56 and with the two constructions tied together to produce the composite waistband 52 of the invention.

Figure 11:
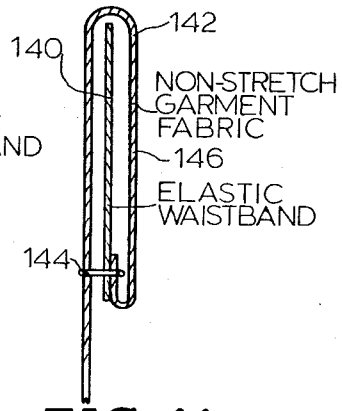
FIG. 11 (PRIOR ART)
FIG. 11 is a simplified diagram of another trade practice for attaching elastic waistband fabric to non-stretch garment fabric and in which the waistband is covered by the garment fabric.
Figure 10:
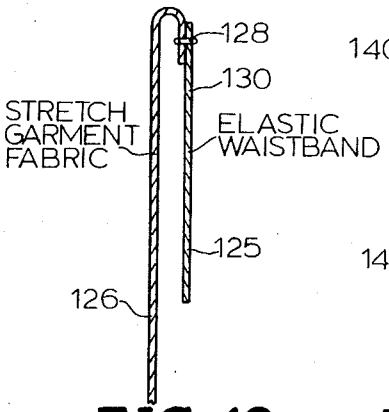
FIG. 10 (PRIOR ART)
FIG. 10 is a somewhat simplified diagram illustrating one prior art method for attaching an elastic waistband to a garment made of stretch fabric.

The description will next describe in more detail in reference to FIGS. 4 and 5 the prior art stitch constructions for the plain elastic fabric 16 and the roll resistant fabric 11 of FIG. 1 noting that the construction of the roll resistant fabric 11 in FIG. 1 is similar to that of the roll resistant fabric 46 in FIGS. 2 and 7. Following this description of the two prior art strip constructions which are sewn together as in FIG. 1, the description will next describe the integrally knitted composite waistband fabric 52 of the invention as illustrated in FIGS. 3, 8, and 9. After describing the construction of the invention waistband fabric 52 in reference to FIG. 9, the description will then refer to various prior art practices for attaching waistbands to both stretch and non-stretch type garment fabric as illustrated in FIGS. 10 and 11. The description will then conclude with reference to FIGS. 12 and 13 in describing how the improved invention waistband may be employed, particularly in garments made of stretch type fabric. From these several descriptions, the unique features and advantages of the invention waistband fabric 52 will become apparent.

As a general statement, it can be said that the knitting constructions shown in FIGS. 4, 5 and 9 represent the respective fabrics as viewed from the back of the fabric and with the bottom of the respective drawings corresponding to the front of the crochet machine and with the top of the respective drawings corresponding to the back of the crochet machine on which the fabrics are knit. As a further general statement, it will be noted that Bar 1 is designated as carrying the warp threads whereas the other bars are designated as carrying the filling threads. Those skilled in the art will also appreciate that in each of the constructions shown in FIGS. 4, 5 and 9 the various illustrated sets of filling threads on the respective Bars 2–6 even though shown as longitudinally spaced sets of threads for purposes of illustration are in fact in effect superimposed on each other in the finished fabric and during knitting.

With the above background in mind and making reference particularly to FIG. 4, the illustrated crochet made, plain stitch elastic fabric construction diagrammed in FIG. 4 corresponds to a four bar construction with Bar 1 carrying the warp threads 70; Bar 2, the filling thread 72; Bar 3, the filling thread 74; and Bar 4, the filling thread 76. In one example of an elastic fabric 16 knit according to the prior art, the warp threads 70 on Bar 1 were single ply, 150 denier, 34 filament, textured, polyester set yarn. In the same example, the filling threads 72 which in FIG. 4 are illustrated as spanning the full width of the fabric 16 were 6 ply, 300 denier, 60 filament, textured, polyester set yarn. The filling threads 74 on Bar 3 which in FIG. 4 are illustrated as shogging back and forth over one needle width were type 1680 denier, uncovered spandex. In the same example, Bar 4 carried three ends of single ply 300 denier, 60 filament, textured, polyester set yarn with the filling threads 76 illustrated in FIG. 4 as also spanning the width of the fabric. The prior art fabric 16 as illustrated in FIG. 4 was knit with the warp and filling threads under normal feed tension and provided an essentially plain stitch, crochet knit, elastic fabric with 50 to 60 percent elastic stretch in the lengthwise or longitudinal direction and essentially no stretch in the transverse or widthwise direction. Additionally, the prior art fabric 16 provided a fabric which, when exposed in the garment presented an attractive appearance whether made with all white or with certain of the mentioned warp or filling threads in selected colors. The mentioned prior art characteristics are thus sought to be retained in the invention fabric.

With continuing reference to the prior art constructions and making specific reference to FIG. 5, the anti-roll resistant fabric 11 illustrated in FIG. 5 in the same example applicable to FIG. 4 employed for the warp threads 80 on Bar 1, a single ply, 150 denier, 30 filament, textured, polyester set yarn. Bar 2 in the same example of FIG. 5 carried the filling threads 82 which are illustrated as spanning the entire width of the anti-roll fabric 11 and comprised single ply, 300 denier, 60 filament, textured, polyester set yarn. Bar 3 carried the filling threads 84 which are illustrated as shogging back and forth one needle width and comprised 1680 denier, uncovered spandex yarn. The filling thread 86 carried by Bar 4 is illustrated as spanning the entire width of the fabric and comprised one end of 750 denier, monofilament, polyester yarn. Bar 5 carried the filling threads 88 which comprised single ply, 300 denier, 60 filament, textured, polyester yarn. A stiffening rib appearance occurs periodically along the length of the anti-roll fabric 11 as illustrated in FIG. 7 by reason of filling threads 88 periodically shogging over a substantial portion of the width of the fabric 11 as illustrated in FIG. 5 followed by shogging over a two-needle width on the left side as further illustrated in FIG. 5. Bar 6, in the construction of FIG. 5, carried a filling thread 90 which comprised a single ply, 300 denier, 60 filament, textured, polyester yarn. Filling thread 90 also contributed to the mentioned stiffening rib effect by following the pattern of spanning something over half of the needles in the widthwise direction of the fabric as further illustrated in FIG. 5 followed by periodic shogging over a width of two needles on the right edge as further illustrated. The just-described construction illustrated in FIG. 5 thus produces a narrow fabric having a substantial anti-roll characteristic, substantial, 50% to 60%, longitudinal stretch and essentially no stretch in the transverse or widthwise direction, characteristics which are desired to be retained in the invention fabric.

In further reference to FIG. 1, the prior art practice has thus been to make on a crochet machine the plain stitch, elastic fabric 16 of FIG. 4, separately make the anti-roll resistant fabric 11 of FIG. 5, finish the plain stitch, elastic fabric 16 in one finish operation, finish the anti-roll resistant fabric 11 in another finishing operation with the two finishing operations being adjusted to correspond to the particular characteristics of the respective fabrics 16 and 11, following which the two fabrics 11 and 16 were joined by the illustrated seam 36 in FIG. 1. In the method of FIG. 1, it is thus apparent that the stitched connection 36 inherently prevents equal stretch between the joined roll resistant fabric portion 32 and plain stitch fabric portion 34 as illustrated in FIG. 1. What the present invention seeks to achieve among other objectives is not only to avoid the need for the stitched connection 36 seen in FIG. 1 but to provide a composite construction which can be integrally knit and which as with FIG. 4 can provide the desired lengthwise extending decorative and comfortably wearing plain stitch fabric construction and in another portion can provide the desired anti-roll resistant characteristic. How these objectives are achieved is next described in reference to FIG. 9.

Making reference to FIG. 9, the illustrated construction for the integrally crochet knit composite waistband fabric 52 of the invention is made as a six bar fabric in which Bar 1 carries the warp threads 100 which in the illustrated example comprise 38 ends of single ply, 150 denier, 30 filament, textured, polyester set yarn. Bar 2 carries the filling thread 102 shown as spanning the entire width of the fabric and which comprises six ends of single ply, 300 denier, 60 filament, textured, polyester set yarn. Bar 3 carries the filling threads 104 comprising 1680 denier, uncovered spandex threads. Bar 4 carries two thread tubes, one of which feeds filling thread 106 comprising three ends of single ply, 300 denier, 60 filament, textured, polyester set yarn. The other tube on Bar 4 carries the filling thread 108 comprising one end of 750 denier, monofilament, polyester yarn. As illustrated in FIG. 9, filling thread 106 is carried back and forth over the left side of the fabric as seen in FIG. 9 whereas filling thread 108 is carried back and forth over the right side of the fabric as seen in FIG. 9. Thus, the monofilament thread 108 becomes part of the roll resistant portion 54 of the composite waistband fabric 52 whereas the multifilament thread 106 becomes part of the plain fabric portion 56 of the composite fabric 52. Continuing with the description of the construction shown in FIG. 9, Bar 5 carries filling thread 110 comprising single ply, 300 denier, 60 filament, textured, polyester set yarn. Filling thread 110 will be noted as passing over a substantial portion of the width of the roll-resistant fabric portion 54 followed by passing back and forth over a two-needle width in the fabric. Bar 6 in FIG. 9 carries filling thread 112 which will also be noted as having a starting portion which swings back and forth over a substantial portion of the width of the roll-resistant fabric portion 54 followed by being passed back and forth over a width of two needles at the right edge as viewed in FIG. 9.

With the construction illustrated in FIG. 6, there is thus achieved a composite, integrally crochet knit waistband fabric 52 which eliminates the need for the sewn seam 36 of FIG. 1 and furthermore provides a fabric which can be finished in a single finish operation without imparting new characteristics to either the roll-resistant portion 54 or the plain fabric portion 56 of the finished waistband fabric 52 of the invention. Furthermore, the construction of FIG. 9 achieves a balanced construction as viewed from different viewpoints. The FIG. 9 construction is balanced in the sense that the finished waistband fabric 52 does not tend to curl in a transverse or widthwise direction and exhibits stiffening rib-like formations 58 seen in FIG. 8 on the front side of the fabric. Additionally, the invention waistband fabric 52 is balanced in the sense of having no tendency to curl in the longitudinal or lengthwise direction. The waistband fabric 52 of the invention is also balanced in the sense of both the roll resistant portion 54 and the plain fabric portion 56 being produced with essentially the same longitudinal stretch and essentially no widthwise or transverse stretch. The waistband fabric 52 of the invention is also balanced in the sense of having long-term wear characteristics which are substantially equal in both the roll-resistant portion 54 and the plain fabric portion 56 with respect to long term effects of cleaning, stretching, and general wear brought about by use in service in the finished garment.

As previously mentioned, the invention waistband 52 also offers significant advantages in the types of fabric with which the waistband can be associated. As background for this part of the description, reference is made to FIG. 10 in which a typical prior art elastic waistband 125 is shown attached to a conventional stretch garment fabric 126 by means of a seam 128. In this somewhat oversimplified example of a prior art waistband-garment construction, it will be noted that the prior art waistband 125 inherently exposes the entire inner surface 130 of the waistband. Thus, whatever surface characteristics of waistband 125 are provided for anti-roll purposes, the wearer of the garment must be exposed to such surfaces in use.

In another example illustrated in FIG. 11, an elastic waistband 140 is shown enclosed in a non-stretch garment fabric 142 by means of a seam 144. In this also somewhat over simplified illustration of a prior art waistband garment construction practice, it will be noted that the waistband 140 is covered by the garment fabric 142. Such garment construction on the one hand offers the advantage of exposing the user to the garment inner surface 146 rather than to the inner surface of the waistband 140, but has a disadvantage of limiting the stretching of the waistband to whatever limited stretch is available in the garment fabric.

Figure 13:
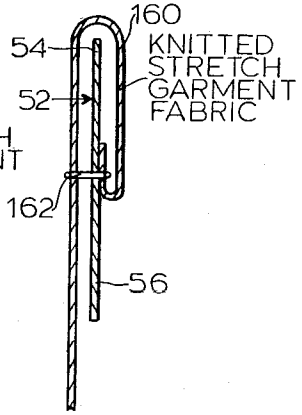
FIG. 13 is another diagram illustrating how the invention waistband can be employed in a garment made of stretch fabric in which the upper roll resistant portion of the invention waistband is covered and the lower decorative and comforable wearing portion is exposed.
Figure 12:
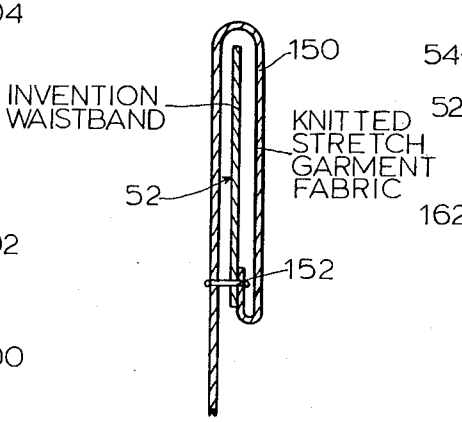
FIG. 12 is a diagram illustrating how the invention waistband can be employed in a knitted garment made of stretch fabric in which the entire waistband is covered.

By comparison, reference is next made to FIGS. 12 and 13 in which the invention waistband 52 is shown in the example of FIG. 12 completely covered by the knitted stretch garment fabric 150 to which the waistband 52 is attached by means of the stitching 152. In FIG. 13, the invention waistband 52 is shown in another configuration in which the knitted stretch garment fabric 160 is shown attached to the waistband 52 of the invention by means of stitching 162 and with the upper roll-resistant portion 54 of the invention waistband 52 being covered by the garment fabric 160 and with the lower plain fabric portion 56 being exposed for wear comfort and decorative purposes. Thus, the invention waistband 52 achieves the desired objective of being adapted to incorporation in a garment made of knitted stretch fabric either in the enclosed form of waistband construction as in FIG. 12 or in the partially enclosed waistband construction as in FIG. 13.

While the invention has been described in reference to a particular crochet knit construction and machine, namely, the Comez type crochet machine, those skilled in the art will recognize the adaptability of the invention construction to other types of warp knit constructions other than the illustrated and described crochet warp knit type construction. For example, those skilled in the art will recognize that Raschel and Tricot-type machines are readily adapted to the invention construction for achieving the described objectives.

In summary, the following characteristics and advantages of the invention waistband fabric 52, as illustrated in FIGS. 3, 8 and 9, are noted:

1. The warp threads in Bar 1 as well as the filling threads in Bar 2, one feed tube of Bar 4, Bar 5, and Bar 6 are all multifilament threads whereas one of the tubes of Bar 4 comprises a monofilament thread.

2. The elastic thread fed by Bar 3 by shogging only one needle width extends substantially warpwise of the fabric and comprises a bare, i.e., uncovered spandex thread. Thus the bare elastic threads even though running substantially warpwise are incorporated for the full width of the fabric and are effectively covered by other filling threads.

3. At least one set of multifilament threads, namely, filling threads 106, are incorporated in only the plain fabric portion 56 of the fabric whereas at least one monofilament thread, namely, filling thread 108 is incorporated only in the roll-resistant portion 54 of the fabric.

4. Both the multifilament filling thread 110 as well as the multifilament filling thread 112 at least periodically sweep over a substantial portion of the width of the roll-resistant portion 54 of the fabric while at other times sweeping over only a narrow, e.g., two-needle width, portion at an outer edge of the fabric.

5. The invention waistband fabric is particularly suited for use with garments made of stretch fabric.

6. The invention waistband fabric is suited for being finished in a single finish operation.

7. Substantial and equal longitudinal stretch and essentiallly no transverse stretch is achieved in both the roll-resistant as well as the plain stitch portion of the invention fabric.

8. The invention fabric tends to lay flat for cutting and handling and exhibits essentially no tendency for curling lengthwise or widthwise.

9. The presence of a sewn seam in the middle of the waistband has been eliminated.

10. Changing fabric characteristics because of use, in service, wear and cleaning are essentially equal in both portions of the invention fabric.

What is claimed is:

1. An elastic waistband comprising an integrally warp knit fabric strip having upper and lower lengthwise extending portions characterised by:

(a) both of said portions being of substantially the same width;

(b) both of said portions incorporating elastic filling threads for the full width thereof and running substantially lengthwise thereof and comprising bare elastic threads prior to the knitting thereof;

(c) both of said portions incorporating at least one multifilament filling thread knitted back and forth across the full width of said strip;

(d) both of said portions providing substantial lengthwise extending elasticity and substantially no widthwise elasticity;

(e) the upper of said portions having at least one additional multifilament filling thread extending across the width thereof and the lower of said portions having at least one additional monofilament filling thread extending across the width thereof;

(f) both of said portions incorporating at least one additional multifilament filling thread which in the knitting thereof follows the sequence of passing back and forth over a major portion of the width of said upper portion followed by passing back and forth over a minor portion of both positions adjacent the join line thereof and connecting said portions together;

(g) said upper portion incorporating a further multifilament filling thread which in the knitting thereof follows the sequence of passing back and forth over a major portion of the width of said upper portion followed by passing back and forth on the selvedge of said upper portion;

(h) said upper portion exhibiting an anti-roll knit construction characteristic in the transverse direction of said strip; and (i) said lower portion exhibiting a plain knit construction and being more flexible transversely than said upper portion.

2. An elastic waistband as claimed in claim 1 wherein said lower portion is of a decorative construction and includes at least some colored threads incorporated therein.

3. A garment having an elastic waistband, said elastic waistband comprising an integrally warp knit fabric strip having upper and lower lengthwise extending portions characterized by:

(a) both of said portions being of substantially the same width;

(b) both of said portions incorporating elastic filling threads for the full width thereof and running substantially lengthwise thereof and comprising bare elastic threads prior to the knitting thereof;

(c) both of said portions incorporating at least one multifilament filling thread knitted back and forth across the full width of said strip;

(d) both of said positions providing substantial lengthwise extending elasticity and substantially no widthwise elasticity;

(e) the upper of said portions having at least one additional multifilament filling thread extending across the width thereof and the lower of said portions having at least one additional monofilament filling thread extending across the width thereof;

(f) both of said portions incorporating at least one additional multifilament filling thread which in the knitting thereof follows the sequence of passing back and forth over a major portion of the width of said upper portion followed by passing back and forth over a minor portion of both portions adjacent the join line thereof and connecting said portions together;

(g) said upper portion incorporating a further multifilament filling thread which in the knitting thereof follows the sequence of passing back and forth over a major portion of the width of said upper portion followed by passing back and forth on the selvedge of said upper portion;

(h) said upper portion exhibiting an anti-roll characteristic in the transverse direction of said strip; and (i) said lower portion exhibiting a plain knit construction and being more flexible transversely than said upper portion.

* * * * *